US007243826B2

(12) United States Patent
Darst

(10) Patent No.: US 7,243,826 B2
(45) Date of Patent: Jul. 17, 2007

(54) PILL BOX AND SPLITTER WITH BLADE GUARD

(75) Inventor: Daniel Darst, Carlsbad, CA (US)

(73) Assignee: Apex Medical Corporation, Sioux Falls, SD (US)

( * ) Notice: Subject to any disclaimer, the term of this patent is extended or adjusted under 35 U.S.C. 154(b) by 218 days.

(21) Appl. No.: 10/672,239

(22) Filed: Sep. 25, 2003

(65) Prior Publication Data

US 2005/0067452 A1 Mar. 31, 2005

(51) Int. Cl.
*B26F 3/00* (2006.01)

(52) U.S. Cl. ..... 225/103; 225/93; 225/104; 30/124

(58) Field of Classification Search ..... 225/103, 225/104, 93; 30/120.1–120.5, 124, 155, 30/278, 248, 285, 286; 87/396–398; 220/495.03, 220/495.01; 241/DIG. 27; D24/100, 101; 206/530, 538, 539, 540; 221/3
See application file for complete search history.

(56) References Cited

U.S. PATENT DOCUMENTS

| | | | | | |
|---|---|---|---|---|---|
| 2,418,958 | A | * | 4/1947 | Stock | 225/104 |
| 2,655,259 | A | | 10/1953 | Davoren | 206/42 |
| 3,175,746 | A | | 3/1965 | Porter et al. | 225/104 |
| 3,349,821 | A | * | 10/1967 | Moeller | 99/646 R |
| 3,439,664 | A | | 4/1969 | Sylvester | 125/23 |
| 3,517,871 | A | | 6/1970 | Gaffney et al. | 225/103 |
| 3,522,752 | A | * | 8/1970 | Ford | 83/389 |
| 3,678,884 | A | | 7/1972 | Robbins | |
| 3,815,802 | A | * | 6/1974 | Stevens | 225/93 |
| 4,009,651 | A | | 3/1977 | Adams | 99/579 |
| 4,173,826 | A | | 11/1979 | Leopoldi et al. | |
| 4,179,806 | A | | 12/1979 | Lieptz | 30/124 |
| 4,422,553 | A | | 12/1983 | Hocks et al. | 206/528 |
| 4,825,552 | A | * | 5/1989 | Bendickson et al. | 30/342 |
| 4,879,932 | A | * | 11/1989 | Scalise et al. | 83/30 |
| 4,887,755 | A | | 12/1989 | Gibilisco | |
| D310,731 | S | | 9/1990 | Lieptz | |
| 5,020,037 | A | | 5/1991 | Raven | 368/10 |
| 5,038,475 | A | | 8/1991 | Wolff | |
| 5,118,021 | A | * | 6/1992 | Fiocchi | 225/103 |
| 5,417,359 | A | * | 5/1995 | Zellner | 225/93 |

(Continued)

FOREIGN PATENT DOCUMENTS

EP 0 313 934 A2 10/1987

OTHER PUBLICATIONS

International Search Report for PCT Application No. PCT/US2004/030478.

(Continued)

*Primary Examiner*—Boyer D. Ashley
*Assistant Examiner*—Omar Flores Sanchez
(74) *Attorney, Agent, or Firm*—Townsend and Townsend and Crew

(57) ABSTRACT

A pill box having a base, a lid with a blade, and a blade guard. The base has a bottom side to which the blade guard is coupled. The base also has a top side with a pill storage compartment, a pill cutting surface, and a pill grip coupled to the pill cutting surface. The lid has a top side and a bottom side with the bottom side having a blade coupled to it. The lid is coupled to the base by one or more hinges.

9 Claims, 10 Drawing Sheets

U.S. PATENT DOCUMENTS

| | | | | |
|---|---|---|---|---|
| 5,944,243 | A * | 8/1999 | Weinstein | 225/93 |
| 6,419,275 | B1 | 7/2002 | Huault | |
| 6,449,218 | B1 * | 9/2002 | Lluch | 368/10 |
| 6,474,525 | B1 * | 11/2002 | Reitano | 225/1 |
| 6,502,311 | B1 * | 1/2003 | Khachatoorian et al. | 30/162 |
| 6,527,155 | B2 * | 3/2003 | Buckley et al. | 225/1 |
| 6,557,945 | B1 * | 5/2003 | Eric | 30/124 |
| 6,601,746 | B2 * | 8/2003 | Buckley et al. | 225/103 |
| 6,739,488 | B1 | 5/2004 | Sharpe | |
| 2002/0179669 | A1 | 12/2002 | Buckley et al. | |
| 2003/0019900 | A1 | 1/2003 | Dienst | |

OTHER PUBLICATIONS

Communication Relating to the Results of the Partial International Search Report for PCT Application No. PCT/US2004/030478.

* cited by examiner

PILL BOX AND SPLITTER WITH BLADE GUARD

BACKGROUND OF THE INVENTION

1. Field of the Invention

The present invention is directed to devices for accurately and safely cutting tablets into smaller parts to reduce dosage or to make them easier to ingest.

2. Description of the Related Art

The present invention is generally directed to a pill splitter that accurately and safely cuts pills into smaller pieces while minimizing the risk of cuts or abrasions to hands and particularly fingers. The pill splitter is also ergonomically designed to make it easier to grip and handle thus further reducing the risk of harm to fingers and hands.

It is well recognized that some tablets are either difficult to swallow because of their relatively large size or contain a dose of an active ingredient that is beyond what the user is required to take at a particular time. For example, it is not uncommon for a physician to instruct a patient to take one half of a pill three times a day or to take one and a half pills three times a day or some other dosage or frequency that involves the necessity of taking half of a pill.

In some cases, it is less expensive to purchase smaller quantities of pills that each have high concentrations of active ingredient per pill rather than a large number of pills with lower concentrations of active ingredient per pill. For those who purchase the higher concentration pills, it becomes necessary to split the pills. For pills which are relatively large in diameter, splitting of the pill can usually be accomplished by grasping the pill between the thumb and forefinger of each hand and applying a breaking force. However, even with the relatively large pills, the breaking force required is often sufficiently great so that it may not be within the capability of the elderly or the feeble or those whose finger-gripping strength or ability has been impaired for some reason.

Many pills are of small diameter and cannot readily be grasped in a manner to achieve the necessary leverage to break them. For these smaller pills, most people find it necessary to use a kitchen knife or similar implement to shear the pill or score it to a greater extent so that it can be broken between the fingers. The pill is placed upon a supporting surface and, when the knife is applied to it, more often than not the pill does not separate cleanly into two halves, but crumbles into several parts. Furthermore, a knife or other sharp object may not always be handy when it is time to take the pill.

Apart from the inconvenience, irritation and frequent crumbling of the pill when using these methods of pill splitting, there is also the possibility of having the pill drop or slip and be lost or contaminated, as well as the more serious problem of possible injury to the hands or fingers if the knife slips.

To solve some of these problems, pill boxes have been made that include compartments with pill grips to hold pills in place and blades to cut through them. One of the problems with such pill boxes is that they have exposed blades that are very sharp and capable of slicing through human skin. This makes them potentially hazardous to the user. Another problem is that they are difficult to handle and ergonomically undesirable, particularly for use by elderly or impaired individuals.

While there have been numerous attempts at producing pill splitters for the purposes intended herein, such pill splitters tend to suffer from one or more of the disadvantages mentioned above. It would therefore be a significant advance in the art to provide a bill box and splitter which can safely and effectively store and split pills while reducing the risk of lacerations to fingers and hands, and which can easily be operated by individuals who may have difficulty gripping objects.

SUMMARY

In one aspect of the invention, a pill box includes a base, a lid connected to the base, and a retractable blade guard secured to the base and engaging the lid. The base includes a pill cutting surface and a pill grip, and the lid includes a blade.

In another aspect of the invention, a pill box includes a base, a lid that is coupled to the base by one or more hinges, and a blade guard. The base has a bottom side and a top side. One end of the blade guard is coupled to the bottom side of the base. The top side of the base has a pill storage compartment, a pill cutting surface, and a pill grip coupled to the pill cutting surface. The lid also has a top side and a bottom side. The bottom side of the lid has a blade coupled to it.

In yet another aspect of the invention, a pill box includes a base, a lid coupled to the base by one or more hinges, and a blade guard. The base has a bottom side and a top side. One end of the blade guard is coupled to the bottom side of the base. The top side of the base has a pill storage compartment, a pill cutting surface, and a pill grip coupled to the pill cutting surface. The lid has a proximal end with a cam and a bottom side with a blade coupled to it. The blade guard is formed by a sheet of plastic that is substantially impermeable to the blade. The blade guard is threaded over the cam and is retractable such that it covers the blade when the lid is open and retracts to expose the blade to the pill cutting surface when the lid is closed.

In another aspect of the invention, a hand-held container includes a base, and a lid connected to the base by one or more hinges. The lid has a top side and a bottom side. A color-coded attachment is detachably fixed to the top side of the lid. The color-coded attachment has a color that indicates a feature of the container.

In yet another aspect of the invention, a kit includes one or more pills and a pill box. The pill box includes a base, a lid connected to the base, and a retractable blade guard secured to the base and engaging the lid. The base includes a pill cutting surface and a pill grip, and the lid includes a blade. The kit can also include instructions for using according to a method of splitting pills. The method can include placing one of the one or more pills on the pill cutting surface such that it is secured by the pill grip. Then closing the lid against the base such that the retractable blade guard exposes the blade to the pill and the blade slices through the pill. Then opening the lid to remove the split pill such that the retractable blade guard returns to its original position covering the blade.

In another aspect of the invention, a pill box includes a base, a lid connected to the base, and a retractable blade guard secured to the base and engaging the lid. The base includes a pill cutting surface and a pill grip, and the lid includes a blade. The blade guard has a raised region that forms a channel that slides over the blade. The channel of the blade guard can be substantially perpendicular to a top of the lid. The blade guard can have one or more wings with raised wingtips formed on either side of the channel, which are designed to slide the blade guard back and forth over the blade. The base has two ramped walls on either side of the pill cutting surface, which work in conjunction with the one or more wingtips to slide the blade guard away from the blade. The two ramped walls are substantially parallel to each other and continue at an upward angle from a distal portion of the base. When the lid is closed against the base, the ramped walls make contact with the one or more wingtips, thereby forcing the blade guard to slide distally along the ramped walls to expose the blade.

Other objects and features of the present invention will become apparent from consideration of the following description taken in conjunction with the accompanying drawings.

DETAILED DESCRIPTION

Figure 1:
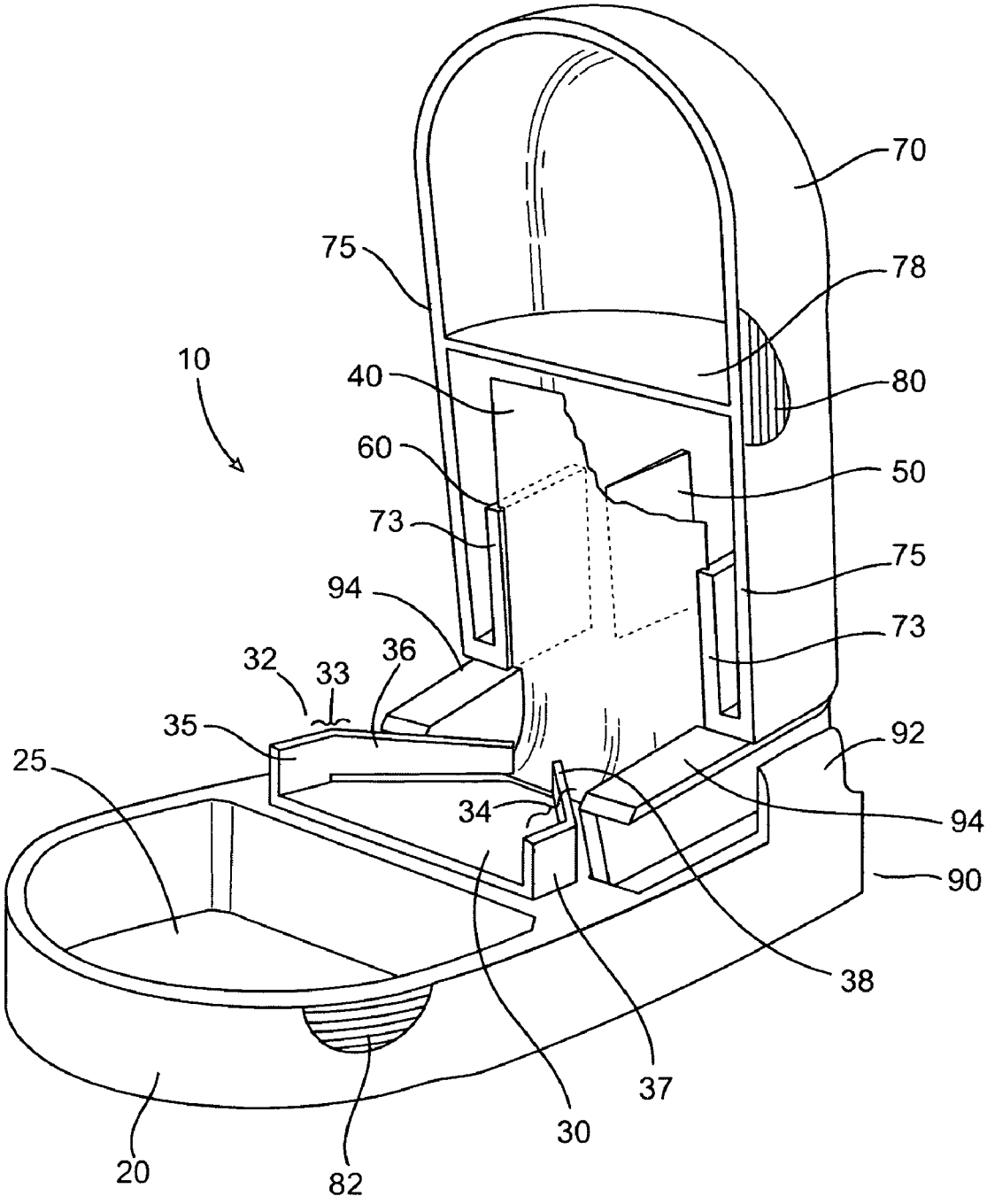
FIG. 1 is a perspective view of an open pill box according to one embodiment.
Figure 3:
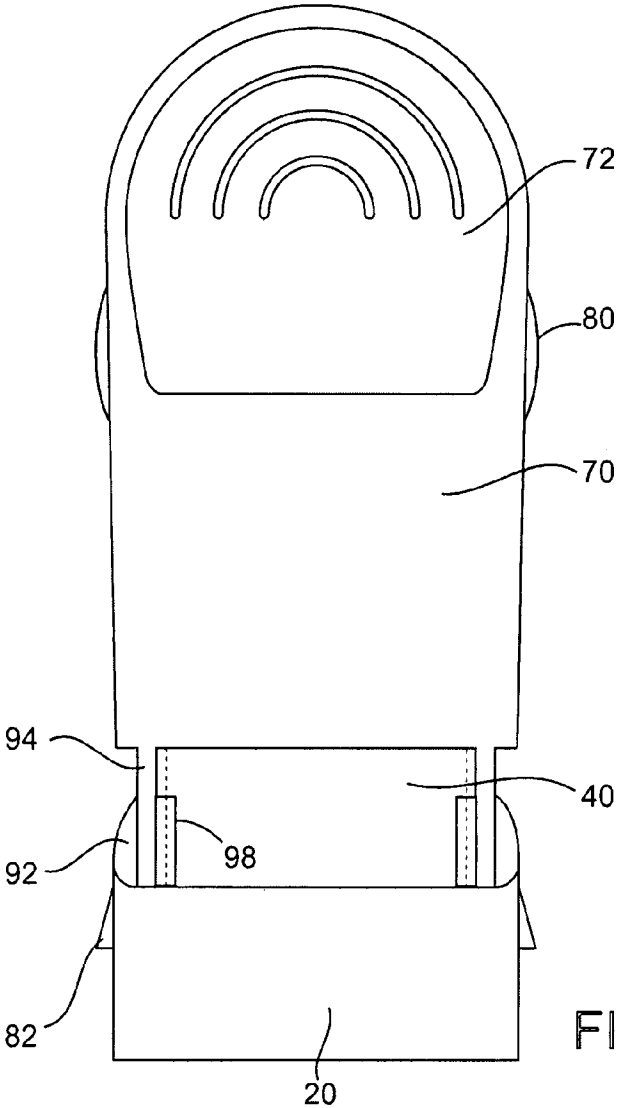
FIG. 3 is a rear view of the pill box depicted in FIG. 1.

Unless defined otherwise, all technical and scientific terms used herein have the same meaning as is commonly understood by one of skill in the art to which the invention(s) belong.

Referring now to FIGS. 1-4B, there is, generally illustrated by reference numeral 10, a pill box 10 in accordance with the principles of the present invention. The pill box 10 has a base 20 and a lid 70. The base 20 and lid 70 can be made of a material that is impermeable to light, opaque, or completely transparent. They can be made of optical grade polycarbonate, or any other rigid and durable material.

The base 20 is connected to the lid 70 by a pair of hinges 90. The hinges 90 are made of a pair of raised arms 92 extending upward from the proximal end of the base 20 on either side of the base, with a round knob (not shown) on each arm 92. The knobs are horizontal and face toward one another, with each knob extending approximately three to five millimeters out from it corresponding raised arm 92. The knobs are mated with round sockets that are carved into the shoulder of two cam arms 94. The hinges 90 can be configured such that the lid 70 can only open to a certain position relative to the base of the pill box. For example, the hinges can be configured such that the lid and the base can only open up to an angle of about 85 degrees. This would lessen the likelihood of a person inserting his finger in between the lid and the base and in contact with the blade. Those skilled in the art will appreciate that various hinge configurations, such as a lock and key configuration, can be used to limit the maximum angle that the lid can be opened with respect to the base.

The two cam arms 94 are on either side of the proximal end of the lid 70. The two cam arms are substantially perpendicular to the lid 70 and are connected to the proximal end of the lid 70. They each form an L shape with the lid 70 being the long arm of an L and the cam arms 94 each forming the short arm of an L. The two cam arms 94 run substantially parallel with one another. Sockets are carved into the shoulders of the cam arms 94, and the knobs are fitted into the sockets.

The cam arms 94 each have a rounded portion 98 (shown in FIG. 4) that projects inward from the cam arm 94, forming a step in the cam arm 94. The rounded portions 98 of the two cam arms face one another.

The base 20 includes a pill compartment 25 that can hold one or more pills. It also contains a pill cutting surface 30 and a pill grip 32 configured to support a pill. The pill grip 32 is made of a first holding arm 33 and a second holding arm 34 for adjustably centering a pill on the pill cutting surface 30 into alignment with the blade 50. The first holding arm 33 includes a first portion 35 that is rigidly coupled to the pill cutting surface 30 and a second region 36 that is flexibly coupled to the first portion 35. The second holding arm 34 also includes a first portion 37 that is rigidly coupled to the pill cutting surface 30 and a second portion 38 that is flexibly coupled to the first portion 37. The first portion 35 of the first holding arm 33 is substantially parallel to the first portion 37 of the second holding arm 34. The second portion 36 of the first holding arm 33 and the second portion 38 of the second holding arm 34 are inwardly biased toward one another. The pill is placed in the space formed between the ends of the second portion 36 of the first holding arm 33 and the second portion 38 of the second holding arm 34. Different sized pills can fit in that space because the second portions 36 and 38 are flexibly coupled allowing them to swing open and away from one another to accommodate different sized pills.

The lid 70 includes a cutting device, such as a blade 50, for slicing through the pills that are positioned on the pill cutting surface in between the two holding arms 33 and 34. The blade 50 has a sharp edge and can be made of double bevel stainless steel, or any other rigid and sharpened material. The blade 50 is attached to the bottom side of the lid 70 and is substantially parallel with the walls 75 of the lid 70. Stated another way, the blade 50 runs lengthwise with the lid 70. The blade 50 is positioned equidistant from the walls 75 of the lid 70, and when the lid 70 is closed, the blade closes through the opening between the first and second holding arms 33 and 34, and makes contact with the cutting surface 30, such that it slices through any pill held by the holding arms 33 and 34. The lid 70 also includes a partition 78. When the lid 70 is closed against the base 20, the partition 78 rests against the base 20, and the proximal side of the wall abuts the cutting surface 30 and the first portion 35 of the first holding arm 33 and the first portion 37 of the second holding arm 34. The partition 78 prevents the pill that is sliced from sliding back into the pill compartment 25.

The blade is securely mounted to the bottom side of the lid 70 to prevent wobble or other movement of the blade during cutting of the pill. In this regard, the edge of the blade that is adjacent the bottom side of the lid can be at least partially or entirely covered by material that extends outwardly along the sides of the blade. This can provide a secure attachment between the blade and the bottom side of the lid 70.

The pill box 10 shown in FIG. 1 is shown at a slightly closed or not completely open formation to show the blade 50 behind the blade guard 40. When the lid is fully open, the blade guard 40 completely covers the blade 50. The blade guard 40 blocks the blade and prevents it from accidentally slicing through fingers or skin when the lid 70 is opened. The blade guard provides a wall or surface that is transverse to the sharp edge of the blade so as to cover the sharp edge and prevent or inhibit a person's finger from contacting the sharp edge of the blade when the pill box is open. When the lid 70 is closed, however, the blade guard 40 retracts and exposes the blade 50 to any pills held by the pill grip 32 and pill cutting surface 30.

Figure 2:
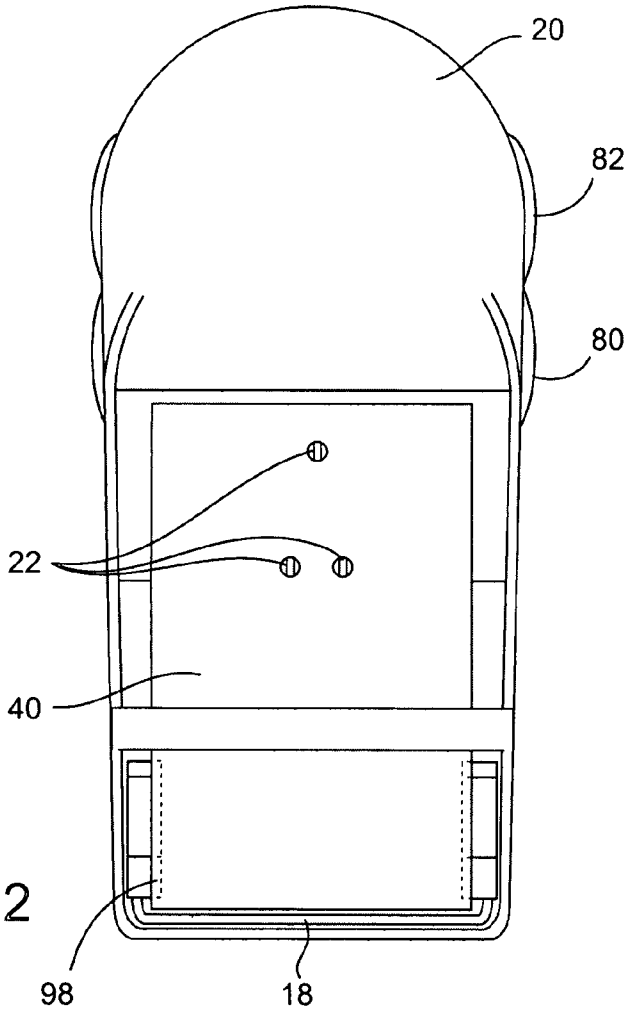
FIG. 2 is a bottom view of the pill box depicted in FIG. 1.
Figure 4A:
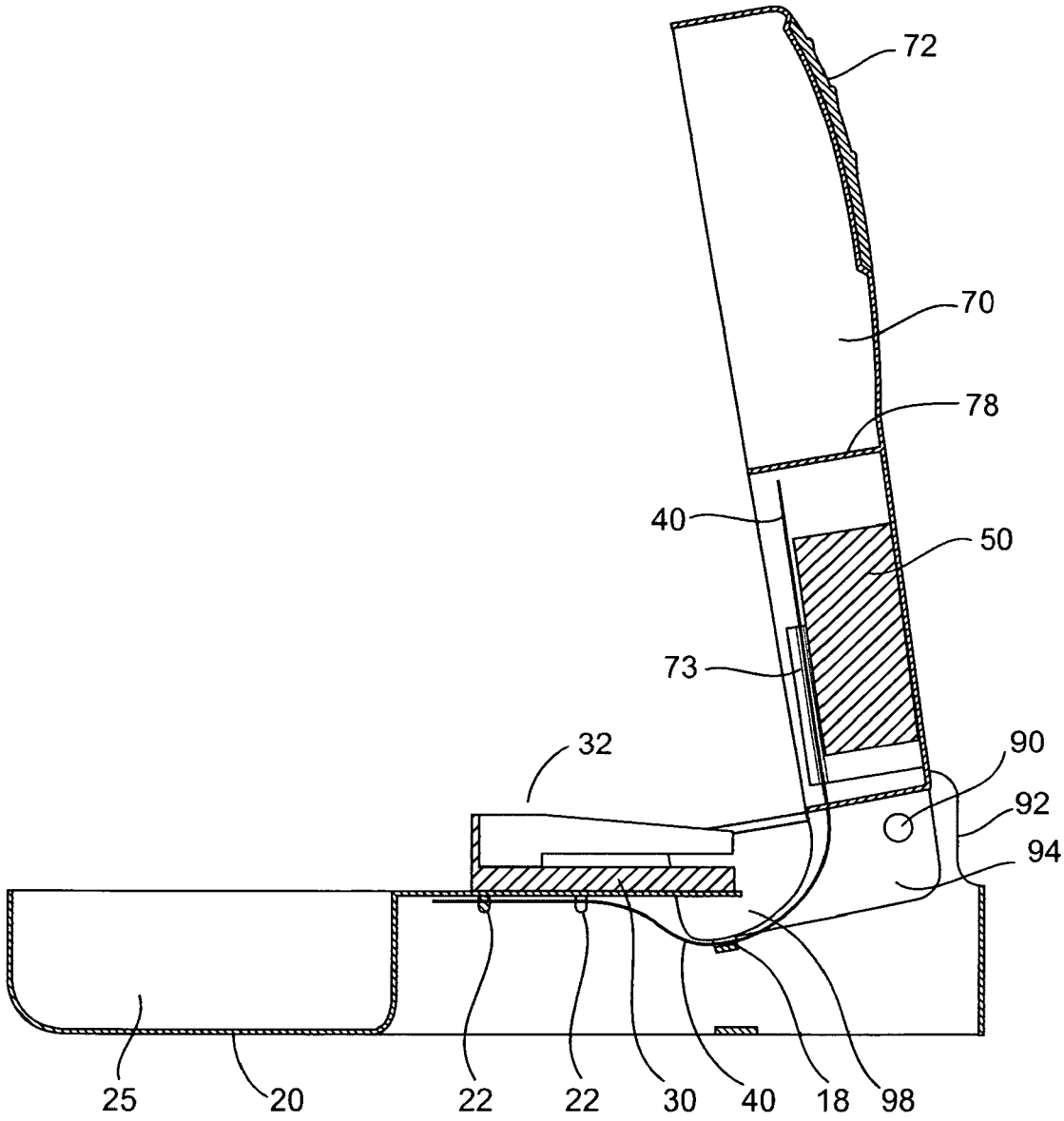
FIG. 4A is a side elevation view of the pill box depicted in FIG. 1 with the lid open.
Figure 4B:
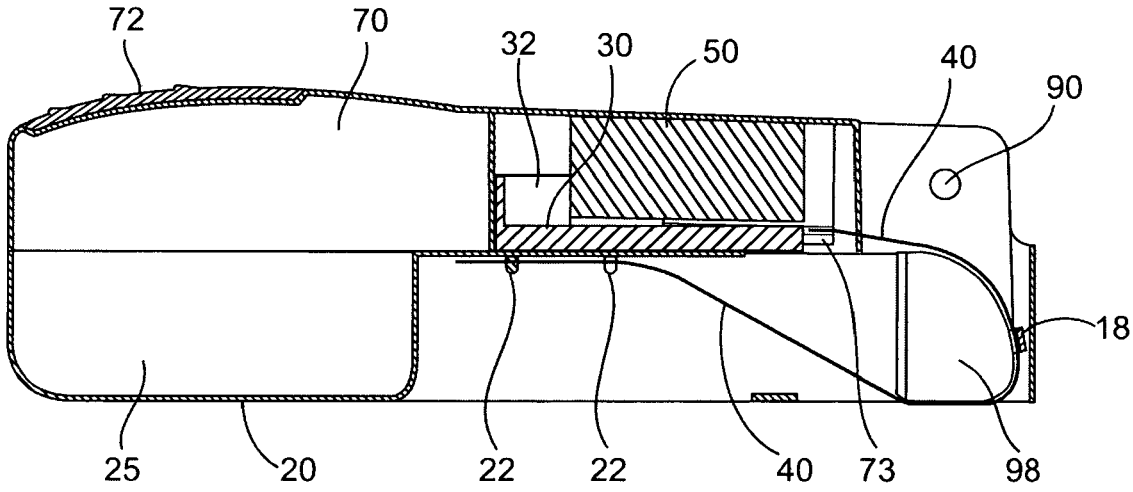
FIG. 4B is another side elevation view of the pill box depicted in FIG. 1 with the lid closed.

The blade guard 40 is a thin sheet of material that is substantially impermeable to the blade 50, such as a strong and durable plastic or flexible metal. As shown in FIGS. 2, 4A, and 4B, the proximal end of the blade guard 40 is attached to the bottom of the base 20 by prongs 22. FIG. 2 shows three prongs 22, but any number of prongs 22 can used to secure the blade guard to the bottom side of the base 20. The blade guard 40 is flexible enough to bend along the rounded portion 98 of the cam arms 94. The sides of the blade guard 40 are abutted against the cam arms 94. A crossmember 18 is attached at its ends to the nadir of the two rounded portions 98 of the cam arms 94, and is offset slightly below the nadir thus forming a thin space between the nadir of the rounded portions 98 and the top of the crossmember 18. The blade guard is threaded over the top of the crossmember 18 and underneath the rounded portions 98 of the cam arms 94 through the space formed between the crossmember 18 and the rounded portions 98 of the cam arms 94. The blade guard 40 is then threaded into channels 60 (shown in FIG. 1) that are formed into inner walls 73, which are perpendicularly connected to the cam arms 94, thus forming an L shape with the cam arms. The inner walls are substantially parallel with the outer walls 75 of the lid 70. The channels 60 guide the blade guard 40 over the blade 50 and retract it away from the blade 40 as the lid 70 is opened and closed. Thus, the rotational movement of the cam 94 is translated into linear movement of the blade guard 40 as the lid 70 is opened and closed.

The cross member 18 and/or the prongs 22 can define one or more channels that are sized to slidably receive the blade guard 40. As the blade guard 40 slides between a retracted and non-retracted position, the positioning of the blade guard within the channels acts as a guide that prevents the blade guard from buckling. In this regard, the slot(s) defined by the cross-member 18 and/or the prongs 22 can have a dimension that is slightly larger than the dimension of the blade guard to provide a snug, yet freely slidable, fit that prevents buckling of the blade guard.

The lid 70 and base 20 can easily be moved relative to one another by using finger grips 80 and 82. Finger grips 82 are integrated into both sides of the base 20. Finger grips 80 are likewise integrated into both sides of the lid 70. When the lid 70 is closed against the base 20, the finger grips 82 are distal the finger grips 80, however, in another embodiment, the finger grips 82 can be proximal the finger grips 80. The finger grips 80 and 82 can have raised ribbing (as shown) to improve a user's grasp of the pill box 10.

The lid 70 has a top side with integrated ribbing molded into it (not shown). The ribbing improves a user's grip. Alternatively, an attachment 72 (see FIG. 3) with ribbing can be detachably fixed to the top side of the lid 70 rather than being molded into the lid 70. The attachment 72 can be color-coded and detachably fixed to the top side of the lid 70. The color (or color combination) of the color-coded attachment can indicate that the container is a pill splitter as opposed to some other product, thus indicating a feature or function of the container. Other colors or color combinations can denote other types of containers, such as a pill crusher, a pill counter, a combination pill splitter and crusher, combination pill splitter and counter, or a combination pill splitter, crusher and counter.

Figure 5:
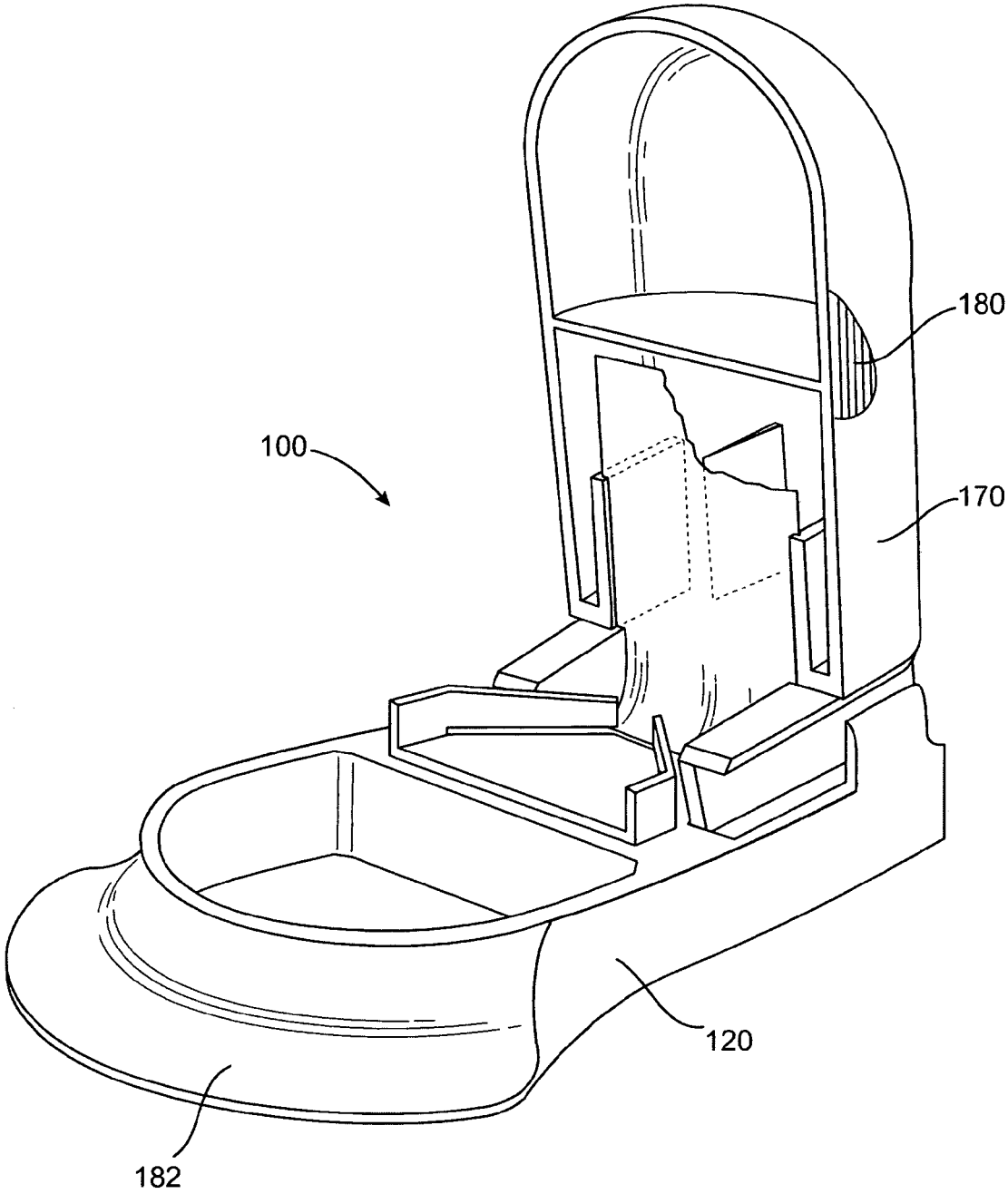
FIG. 5 is a perspective view of an open pill box according to another embodiment.

FIG. 5 shows another embodiment of a pill box 100. The pill box 100 is similar to pill box 10 depicted in FIGS. 1-4B, and can include a blade and blade guard identical to the blade and blade guard in pill box depicted in FIGS. 1-4. The main difference between pill box 100 and pill box 10, is that pill box 100 includes a retention lip 182 and a thumb press (not shown) on the lid instead of attachment 72. The retention lip 182 is integrated into the and the distal end of the base 120. It can be used to hold the pill box 100 down while pulling open the lid using the finger grips 180 integrated into the lid 170. The thumb press is a thumb-sized concave region carved into the top side of the lid 170 at the distal end of the lid. The thumb press receives a user's thumb for ergonomic closure of the lid 170 against the base 180.

Figure 6:
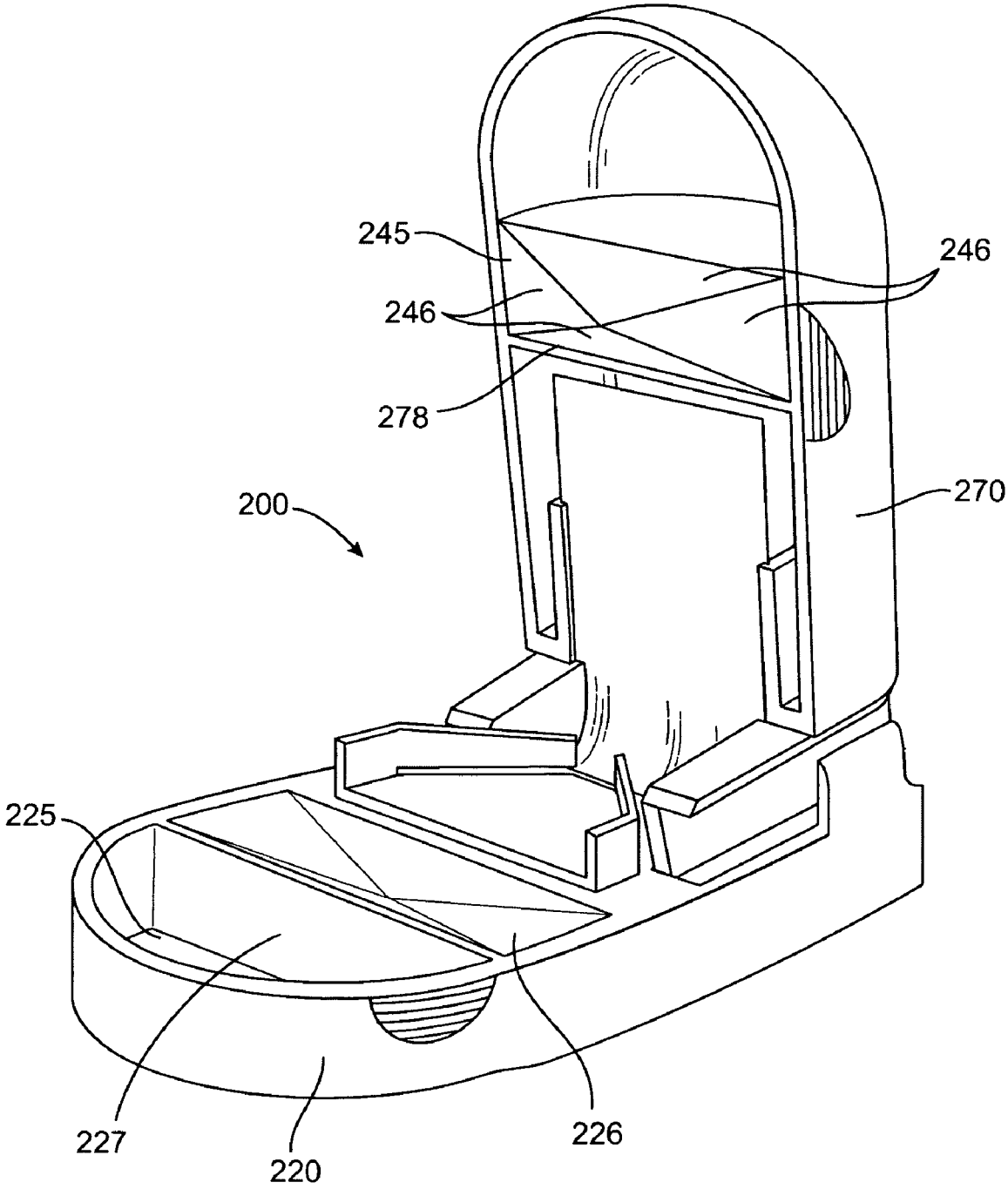
FIG. 6 is a perspective view of an open pill box according to another embodiment.

As shown in FIG. 1, the pill box 10 has a pill compartment 25 formed into the base. Above the pill compartment is dead space that is surrounded by the distal end of the lid 70 and the partition 78. The pill box 200 shown in FIG. 6 includes a pill crusher 245 integrated into the bottom side of the lid 270 and utilizing a portion of that dead space. The pill crusher 245 is a protuberance integrated into the bottom side of the lid 270. It is distally adjacent to the partition 278 and is mated with a crusher compartment 226 carved into the base. The crusher compartment 226 is separated from the pill storage compartment 225 by a pill storage retention wall 227. The pill crusher 245 can be a rectangular pyramid shape as shown in FIG. 6, with the corresponding crusher compartment 226 shaped to receive the pill crusher 245 such that all of the surfaces 246 of the pyramid are in continuous contact with all of the surfaces of the crusher compartment 226 when the lid 270 is closed against the base 220. The pill crusher 245 can have other shapes as well. For example, the pill crusher 245 can have a conical or frustoconical shape with a corresponding crusher compartment. Alternatively, it can be shaped like a spherical wedge with a corresponding crusher compartment. In still another alternative, it can form a hemisphere with a corresponding crusher compartment. In yet another alternative, the crusher compartment can have a crenated surface while the crusher forms a flat rectangular surface that rests against the crenated surface of the crusher compartment when the lid 270 is closed against the base 220. Alternatively, the crusher compartment can have a flat surface, while the crusher is crenated. In any case, when a pill is placed in the crusher compartment 226 and the lid 270 is closed against the base 220, the pill is crushed between the apex and surfaces 246 of the pill crusher 246 and the surface of the pill crusher compartment 226.

Figure 7:
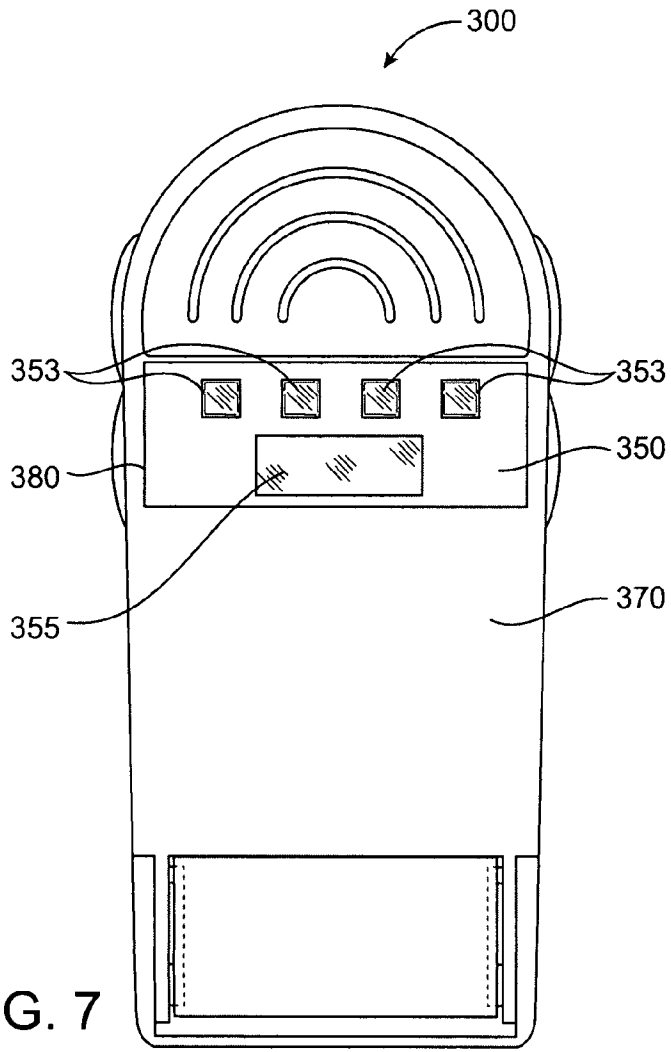
FIG. 7 is a top view of a pill box according to another embodiment.

FIG. 7 shows a pill box 300 with an integrated pill counter 350. The pill counter 350 includes a microprocessor and can be programmed by the user to remind the user to take a pill as often as programmed. It also includes programming buttons 353 to program the pill counter, and a display 355 that can show the number of pills remaining; the number of pills already taken; the time; the dosage per pill; ingestion frequency, and other indications that are known to those of skill in the art. The pill counter 350 fits into the lid 370. The lid 370 has a cutout portion 380 that receives the pill counter display and programming buttons as shown in FIG. 7.

The pill crusher depicted in FIG. 6 can be combined with the pill counter depicted in FIG. 7 to form a combination pill crusher, counter, and splitter (not shown). The pill crusher would be attached to the bottom of the pill counter 350, thus extending downward from the pill counter 350 and the lid 370 lid. The pill crusher can be any of the shapes described with respect to FIG. 6 and is mated with a crusher compartment carved into the base (as in FIG. 6). The crusher compartment is separated from the pill storage compartment by a pill storage retention wall (as in FIG. 6).

Figure 8:
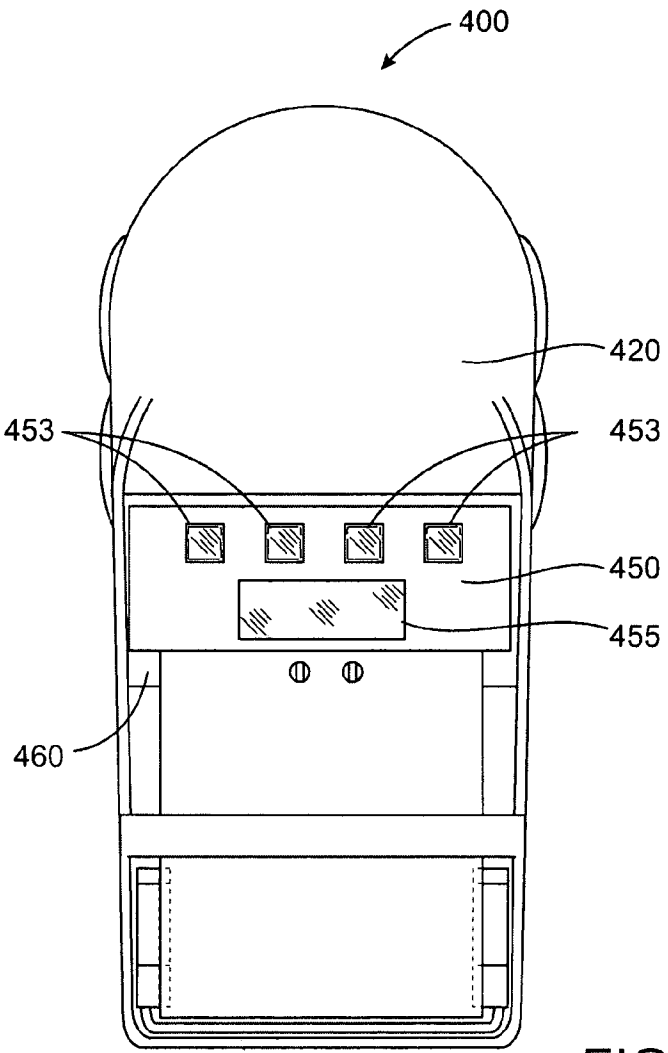
FIG. 8 is a bottom view of a pill box according to another embodiment.

FIG. 8 shows an alternative embodiment of a pill box with an integrated pill counter. The pill box 400 has a pill counter 450 that is placed on the bottom side of the base 420 instead of the lid (as shown in FIG. 7). The bottom side of the base 420 has a cavity 460 into which the pill counter 450 is placed. As with the pill counter 350, the pill counter 450 includes a microprocessor and can be programmed by the user to remind the user to take a pill as often as programmed. It also includes programming buttons 453 to program the pill counter, and a display 455 that can show the number of pills remaining; the number of pills already taken; the time; the dosage per pill; ingestion frequency, and other indications that are known to those of skill in the art.

Figure 9:
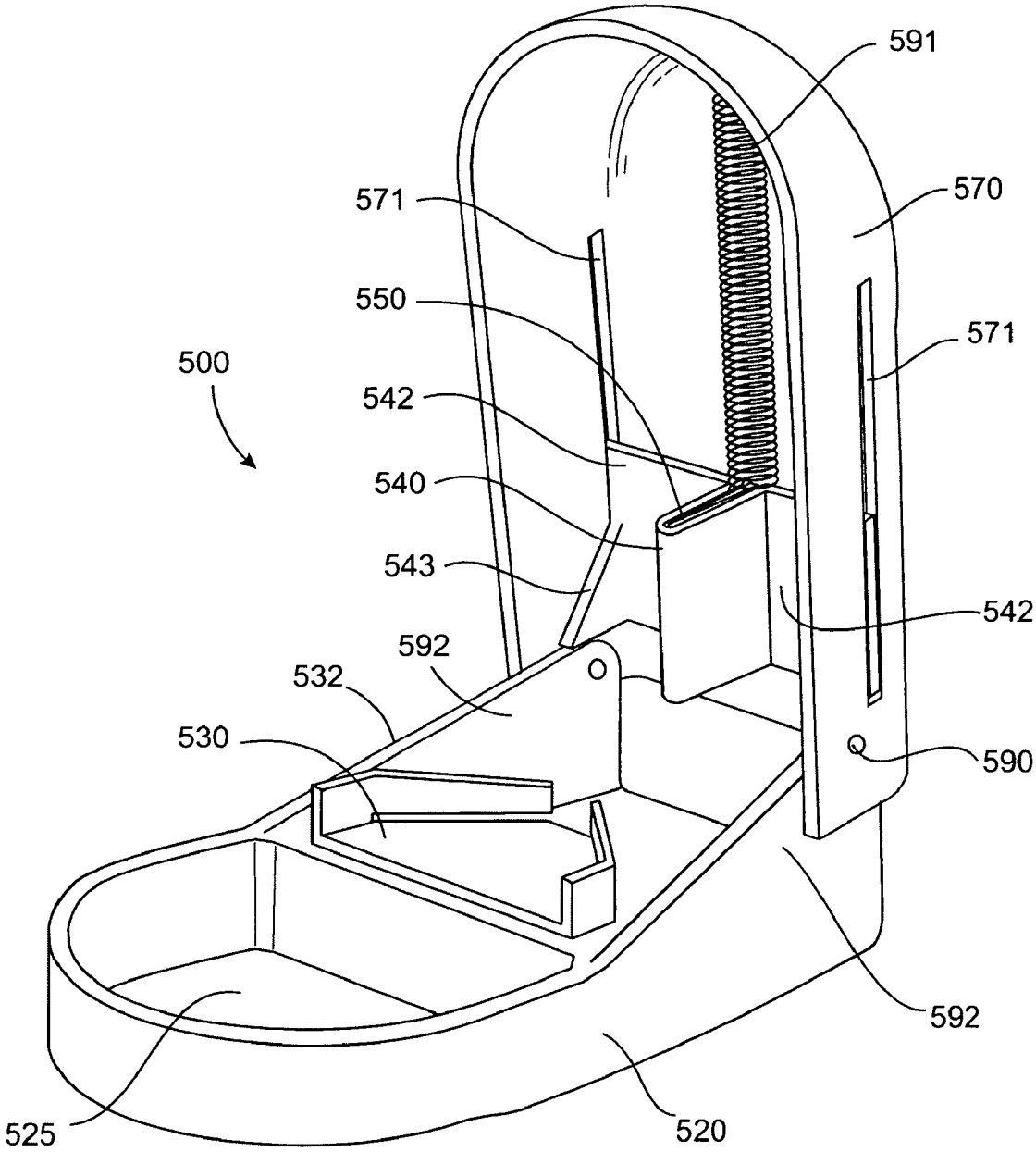
FIG. 9 is a perspective view of an open pill box according to another embodiment.

FIG. 9 shows another embodiment of a pill box 500 with blade guard 540. Like the pill box depicted in FIG. 1, the pill box 500 includes a base 520 and a lid 570. The base 520 is connected to the lid by hinges 590. The base 520 has a pill storage compartment 525. It also has a pill cutting surface 530 and a pill grip area 532 that are the same as the pill cutting surface and pill grip area of the pill box shown in FIG. 1. The lid 570 has an integrated blade 550, and it is positioned and connected to the lid 570 is the same manner as the pill box shown in FIG. 1. The blade guard 540 has a central raised region that forms a channel that slides over the blade 550. The raised region of the blade guard 540 and the blade 550 are both substantially perpendicular to the top of the lid 570.

As stated above, the blade guard 540 has a central raised region that forms a channel through which the blade slides. Extending laterally from both sides of the channel are flat wings 542. The ends of the wings 542 are fitted into tracks 571, along which the blade guard 540 slides. The ends of the wings 542 also have finned wingtips 543 that are adjacent the walls of the lid. The wingtips 543 are substantially parallel to the blade 550 and the raised region of the blade guard 540.

Figure 10A:
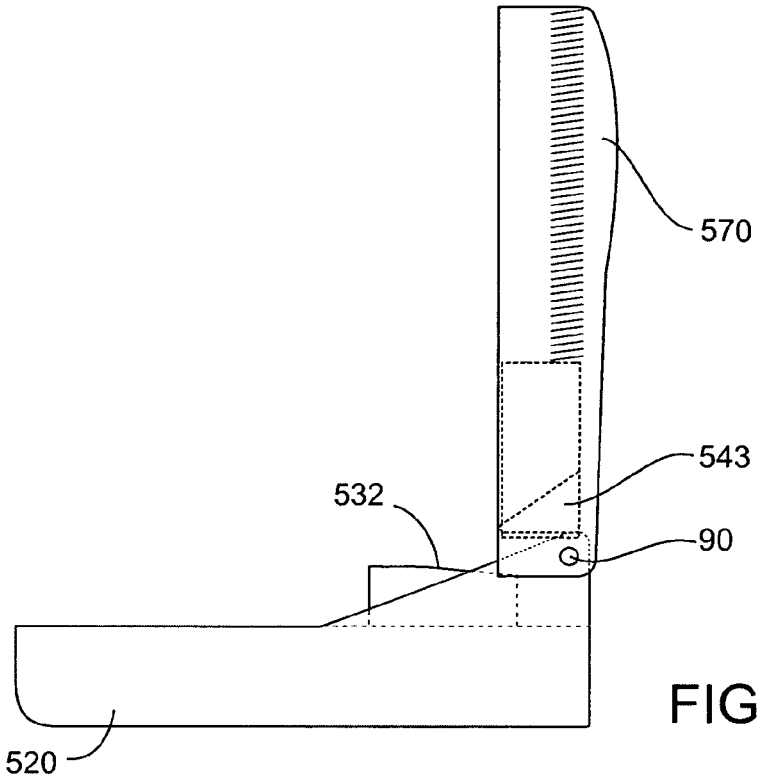
FIG. 10A is a side elevation view of the pill box depicted in FIG. 9 with the lid completely open.
Figure 10B:
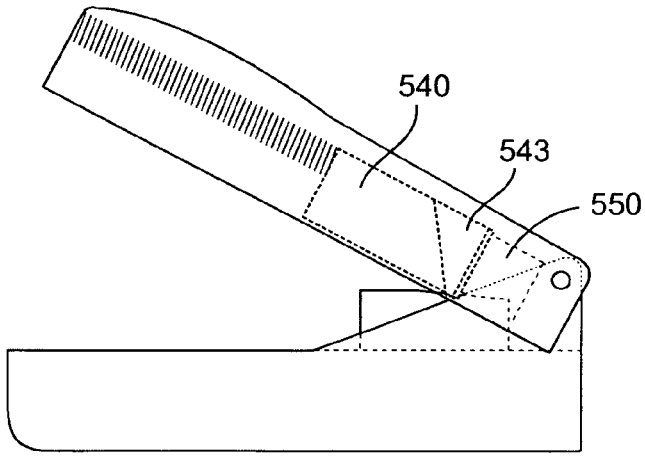
FIG. 10B is a side elevation view of the pill box depicted in FIG. 9 with the lid partially open.
Figure 10C:
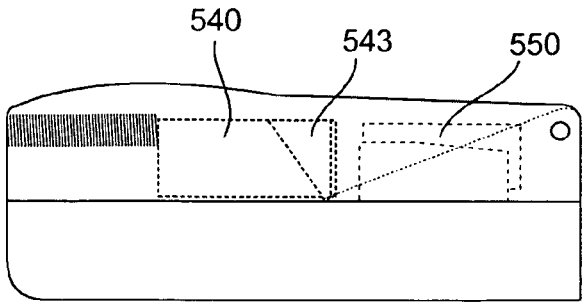
FIG. 10C is a side elevation view of the pill box depicted in FIG. 9 with the lid closed.

The wingtips 543 are lined up with two ramped walls 592 that rise up from base 520 at either side of the pill cutting surface 530 and pill grips 532. When the lid 570 is closed against the base 520, the wingtips 543 come into contact with the ramped walls 592. As shown in sequence in FIGS. 10A-10C, the wingtips 543 slide distally down the ramped walls 592 along the tracks 571, thus also moving the entire blade guard 540 toward the distal end of the lid 570 and consequently exposing the blade 550. A compression spring 591 is mounted on one end to the distal end of the blade guard 540, and on its other end it is mounted to the distal end of the lid 570. The compression spring exerts a force against the blade guard 540, thus pushing the blade guard 540 over the blade 550 when the lid 570 is open. Alternatively, the blade guard 540 can slide back over the blade 550 using gravity, such that when the lid is opened gravity brings the blade guard 540 back down over the blade 550.

Figure 11:
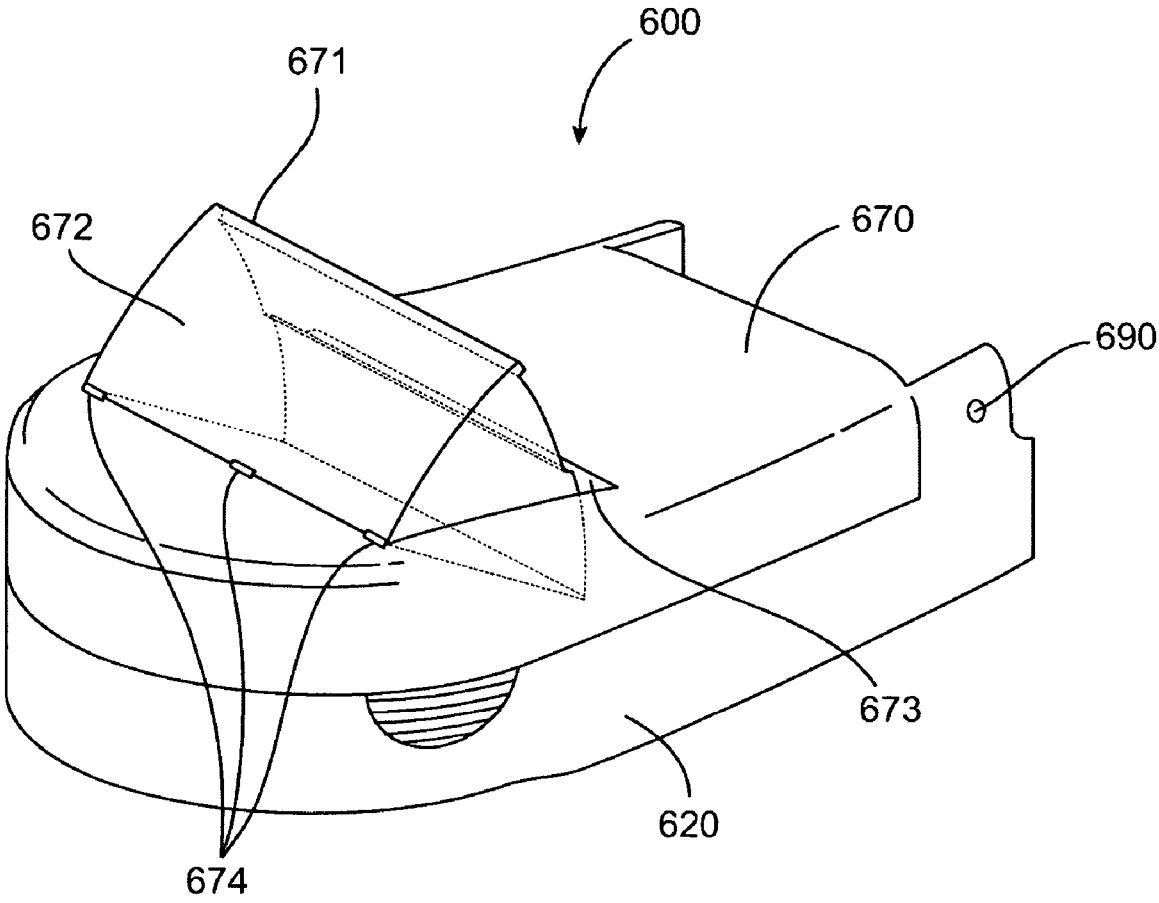
FIG. 11 is a perspective view of a pill box according to another embodiment.

FIG. 11 shows another embodiment of a pill box. The pill box 600 shown in FIG. 11 is similar to the pill box shown in FIGS. 1-4B with the main difference being that the pill compartment shown in FIG. 11 has a different configuration and placement than the pill compartment shown in FIGS. 1-4B. The pill box 600 has a lid 670 attached to a base 620 by hinges 690. The lid has a cutout portion 673 that can be square or rectangular. Fitted through the cutout portion 673 is a pill storage container 671. The pill storage container 671 has a spherical wedge shape, and is connected to the lid 670 by hinges 674. The hinges 674 allow the pill storage container 671 to rotate about the hinges 674 and the lid 670. The top surface side 672 of the pill storage container 671 forms a trap door which can be lifted open to obtain access to pills stored in the pill storage container 671.

The pill boxes described herein can be provided in kit form along with instructions for use and prescription or over-the-counter medications. In particular, prescriptions or over-the-counter pills that are sold or provided in large dosage form can be sold with the pill boxes described herein, which can be used to reduce the size of the pills. The instructions would include an explanation of a method of splitting pills using the pill boxes. The method would include, placing one of the pills on the pill cutting surface of the pill box such that it is secured by the pill grip. The next step would involve closing the lid against the base such that the retractable blade guard exposes the blade to the pill and the blade slices through the pill. In the next step, the user would open the lid to remove the split pill such that the retractable blade guard returns to its original position covering the blade.

Although embodiments of various methods and devices are described herein in detail with reference to certain versions, it should be appreciated that other versions, embodiments, methods of use, and combinations thereof are also possible. Therefore the spirit and scope of the appended claims should not be limited to the description of the embodiments contained herein.

What is claimed is:

1. A pill box comprising:

a base having a pill cutting surface;

a lid connected to the base, the lid having a blade; and a retractable blade guard secured to the base and engaging the lid, wherein the lid comprises a cam, and wherein the blade guard is threaded over the cam.

2. The pill box of claim 1, wherein the blade guard is retractable such that it covers the blade when the lid is open and retracts to expose the blade when the lid is closed.

3. A pill box comprising:

a base comprising a bottom side and a top side, the top side having a pill storage compartment, a pill cutting surface, and a pill grip coupled to the pill cutting surface;

a lid having a top side and a bottom side, the bottom side having a blade coupled thereto, wherein the lid is coupled to the base by one or more hinges;

a retractable blade guard coupled at one end to the bottom side of the base, wherein the lid comprises a cam, and wherein the blade guard is threaded over the cam.

4. A kit comprising:

one or more pills; and a pill box comprising:

a base having a pill cutting surface and a pill grip;

a lid connected to the base, the lid having a blade; and a retractable blade guard secured to the base and engaging the lid, wherein the lid comprises a cam, and wherein the blade guard is threaded over the cam.

5. A pill box comprising:

a base comprising a bottom side and a top side, the top side having a pill storage compartment, a pill cutting surface, and a pill grip coupled to the pill cutting surface;

a lid having a proximal end with a cam and a bottom side having a blade coupled thereto, wherein the lid is coupled to the base by one or more hinges; and a blade guard comprising a sheet coupled at one end to the bottom side of the base, wherein the blade guard is threaded over the cam and is retractable such that it covers the blade when the lid is open and retracts to expose the blade to the pill cutting surface when the lid is closed.

6. The pill box of claim 5, wherein the pill grip comprises a first holding arm and a second holding arm for adjustably centering a pill on the pill cutting surface into alignment with the blade.

7. The pill box of claim 6, wherein the first holding arm comprises a first portion that is rigidly coupled to the pill cutting surface and a second region that is flexibly coupled to the first portion, and wherein the second holding arm comprises a first portion that is rigidly coupled to the pill cutting surface and a second portion that is flexibly coupled to the first portion, the first portion of the first holding arm parallel to the first portion of the second holding arm, the second portion of the first holding arm and the second portion of the second holding arm inwardly biased toward one another.

8. The pill box of claim 5, wherein the bottom side of the lid comprises a first wall having a channel formed along its length and a second wall with a channel formed along its length, wherein the first and second walls run parallel with the each other and the blade, and wherein the channels face each other.

9. The pill box of claim 8, wherein the channels in the first and second walls receive the blade guard.

* * * * *